US005471717A

United States Patent [19]

Ennerdal et al.

[11] Patent Number: 5,471,717

[45] Date of Patent: Dec. 5, 1995

[54] SAFETY-BELT ARRANGEMENT

[75] Inventors: Leif Ennerdal, Alingsas; Thomas Magnusson, Boras, both of Sweden

[73] Assignee: Autoliv Development AB, Vargarda, Sweden

[21] Appl. No.: 214,323

[22] Filed: Mar. 17, 1994

[51] Int. Cl.[6] ..... A44B 11/00

[52] U.S. Cl. ..... 24/633; 24/639

[58] Field of Search ..... 24/633, 634, 635, 24/639, 637, 638, 640, 644, 68 CD

[56] References Cited

U.S. PATENT DOCUMENTS 3,226,791 1/1966 Carter ..... 24/638
3,408,707 11/1968 Hemphill ..... 24/639

FOREIGN PATENT DOCUMENTS 3043432 6/1982 Germany ..... 24/633
2244079 11/1991 United Kingdom .
2247821 3/1992 United Kingdom .

*Primary Examiner*—Victor N. Sakran
*Attorney, Agent, or Firm*—Spencer, Frank & Schneider

[57] ABSTRACT

A tongue forming part of a safety belt is provided with two apertures adapted to receive the safety belt. The tongue has a portion adapted to be received and retained by a buckle forming part of a safety belt system. The tongue carries a clamping element adapted to be moved, by pressure applied to the clamping by the safety belt, to a clamping position in which the clamping element clamps part of a safety belt locking means are provided movable between a locking position and a release position. When the locking means are in the locking position the clamping element is prevented from moving to the clamping position. However, when the locking means are in the release position the clamping element may move to the clamping position.

10 Claims, 2 Drawing Sheets

SAFETY-BELT ARRANGEMENT

BACKGROUND OF THE INVENTION

The present invention relates to a safety-belt arrangement and more particularly relates to a tongue adapted to be mounted on a safety belt and adapted to be received within a buckle to retain the safety-belt in position.

It has been proposed to provide a tongue for use with a safety-belt with a clamp adapted to clamp the belt, so that the tongue is effectively secured "permanently" to the belt in a selected position. Such a clamp may, of course, be releasable. A clamp of this type is disclosed, for example, in GB-A-2247821. An alternative form of clamp is disclosed in GB-A-2244079.

SUMMARY OF THE INVENTION

The present invention seeks to provide a tongue for use with a safety-belt having a clamp, in which the clamp can be retained in the inoperative condition at will.

According to this invention there is provided a tongue defining apertures adapted to receive the safety-belt, and having a portion adapted to be received and retained by a buckle forming part of a safety-belt system, the tongue carrying a clamping element adapted to be moved, by pressure applied to the clamping element by the safety-belt, to a clamping position in which the clamping element clamps part of the safety-belt, locking means being provided movable between a locking position and a release position, the locking means being adapted, in the locking position, to prevent the clamping element from moving to the clamping position and being such that when in the release position the clamping element may move to the clamping position.

Preferably the tongue defines a peripheral frame have a cross-arm, defining two apertures through which the safety-belt may pass, the clamping element being mounted on the cross-arm and being movable to a clamping position in which part of the clamping element traps the safety-belt passing through one of the apertures against the peripheral frame.

Conveniently the locking element comprise an element which is mounted on the cross-arm for movement transversely of the frame, the locking element carrying means which, when the locking element is in the locking position engage co-operating means formed on the clamping element to prevent the clamping element from moving to the clamping position.

Advantageously the locking element carries means projecting through a slot formed in the clamping element, the slot being of substantially "L" configuration, the slot being such that when the locking element is in the release position, the projection is aligned with part of the "L"-shaped slot which is so orientated that the clamping element may move to the clamping position whereas when the locking element is in the locking position the projection is in part of the slot which is so orientated that the clamping element cannot move to the clamping position.

Preferably the locking element carries an extending projection, the projection being located so that when the locking element is in the locking condition the projection is immediately adjacent an abutment carried by the clamping element, thus preventing the clamping element from moving to the clamping position whereas when the locking element is in the release position, the projection is located adjacent a recess formed on the clamping element, so that the clamping element may move to the clamping position.

Conveniently the locking element comprises an element movable in a slot formed in the cross-arm of the frame, the locking element being provided with at least one resilient finger carrying a projection, which projection is engagable with recesses forming part of the side wall of the slot to retain the locking element in the locking position or in the release position.

BRIEF DESCRIPTION OF THE DRAWINGS

In order that the invention may be more readily understood, and so that further features thereof may be appreciated, the invention will now be described, by way of example, with reference to the accompany drawings in which.

DETAILED DESCRIPTION OF THE INVENTION

Figure 2:
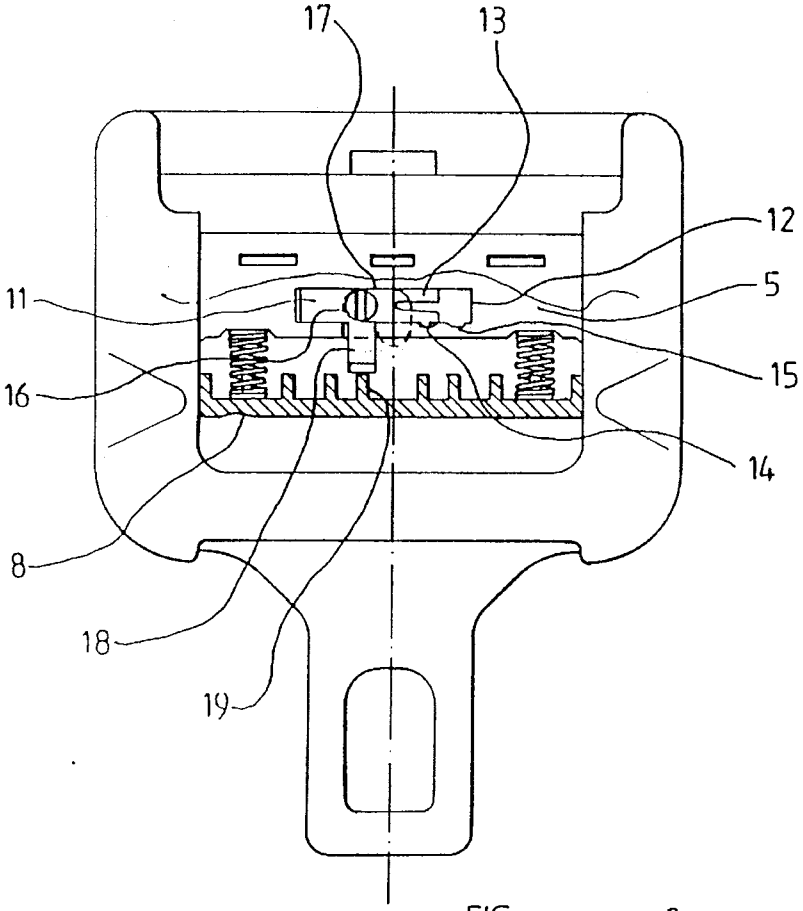
FIG. 2 is a view corresponding to FIG. 1 showing the clamp in the inoperative condition.

A tongue 1 as shown in the accompanying drawings is adapted to be used, in conjunction with a safety-belt, to secure the safety-belt to a buckle.

The tongue 1 comprises a metallic element defining a projecting portion 2 having a central aperture 3, which portion is designed to be inserted into, and to be retained by, a buckle. This part of the tongue may be of any conventional design.

The projecting portion 2 is formed integrally with an element which defines a peripheral frame 4 having a central cross-arm 5, and which thus defines two spaced-apart apertures 6,7, through which the safety-belt may be threaded. Mounted on the cross-arm 5 is a movable clamping element 8 biassed towards a release position by appropriate springs 9.

The metallic element may be provided with plastic sheathing 10 in order to improve the appearance and performance of the tongue.

The clamping element 8 effectively comprises a plastics material member which surrounds the cross-arm 5, and which can move, in the plane of the peripheral frame 4 towards that part of the frame which is remote from the projecting portion 2, enabling the safety-belt which passes through the aperture 7 to be clamped against that part of the frame, when pressure is applied to the clamping element 8 to move the clamping element against the bias provided by the springs 9. Such a clamping element has been generally proposed before, as can be seen from GB-A-2244079.

Figure 1:
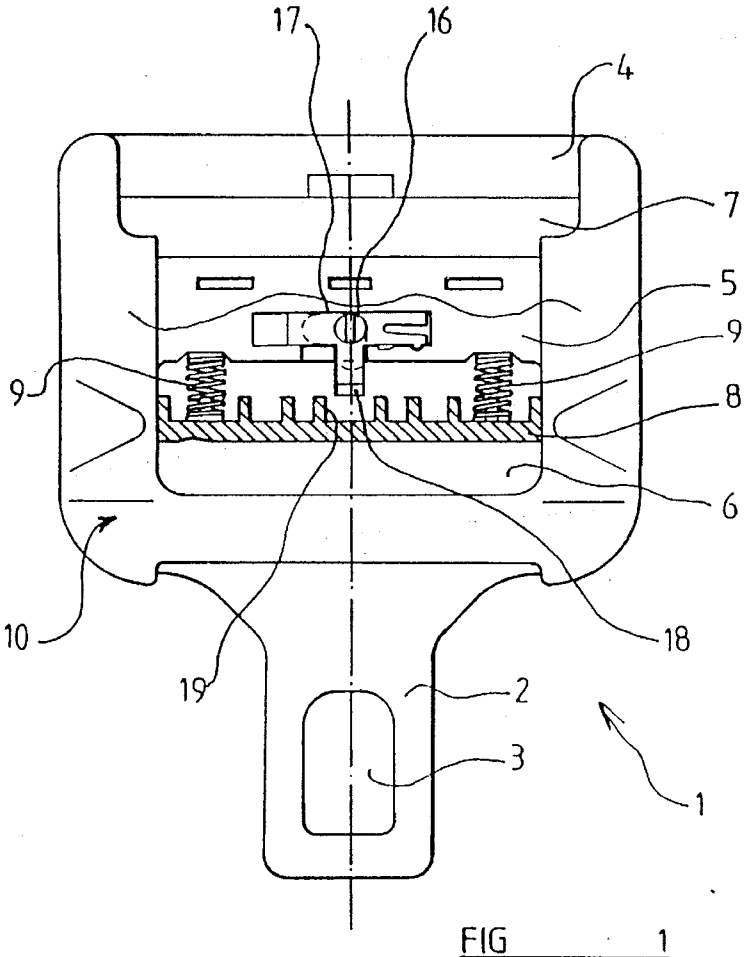
FIG. 1 is an elevational view of a tongue in accordance with the invention shown partly in section, with the clamp in the operative condition.

A locking arrangement is provided on the tongue illustrated in FIGS. 1 and 2, which can be in a locking condition, as shown in FIG. 2, when the locking arrangement prevents the clamping element 8 from moving to the clamping position, or a release condition, as shown in FIG. 1, in which the clamping element 8 can move to the clamping position.

The locking arrangement comprises a locking element 11 which is mounted for sliding motion in a slot 12 formed in the cross-arm 5 of the frame. The locking element 11 is provided, at one end, with two fingers 13 which are resiliently biassed apart. One finger carries a projection 14 adapted to be received in one of two depressions 15 provided in the side of the slot 12. Thus the locking element 11 may be retained in two alternate positions, as shown in FIGS. 1 and 2.

The locking element 11 is provided with a projection 16 which extends through a substantially "L"-shaped slot 17 formed in the clamping element 8 which totally surrounds the cross-arm 5 of the frame. The projection 16 is thus accessible to permit movement of the locking element 11 between the two alternate positions described above.

The "L"-shaped slot is such that when the locking element 11 is in the release position as shown in FIG. 1, the operating projection 16 is aligned with a portion of the "L"-shaped slot 17 which extends in the direction of movement of clamping element 8 as it moves to the clamping position whereas, when the locking element is in the locking position, of FIG. 2, the operating projection 16 is located in part of the slot 17 which does not extend axially in the direction of movement of the clamping element towards the clamping position. Thus, when the locking element is in the locking position, the cooperation between the projection 16 and the slot 17 is such as to tend to prevent movement of the clamping element to the clamping position, whereas when the locking element is in the release position, the clamping element can move to the clamping position.

It can be seen that the locking element 11 carries a projecting finger 18 which projects towards a series of inwardly directed fingers 19 carried by the clamping element 8. When the locking element is in the release position of FIG. 1 the finger 18 is aligned with a gap between the fingers 19, thus enabling the clamping element to move to the clamping position. In contrast, when the locking element is in the locking condition, as shown in FIG. 2, the finger 18 abuts a finger 19, thus preventing movement of the clamping 8 to the clamping position.

Figure 3:
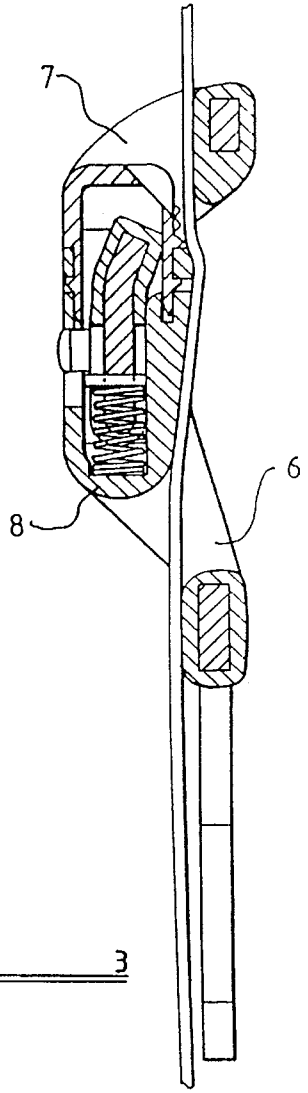
FIG. 3 is a sectional view of one embodiment of a tongue in accordance with the invention in a first condition.

FIG. 3 illustrates a tongue in accordance with the invention, with a safety-belt passing through the apertures 7 and 8. The tongue in FIG. 3 is not being utilised, and it is thus immaterial whether the locking member is in the locking position or in the release position.

Figure 4:
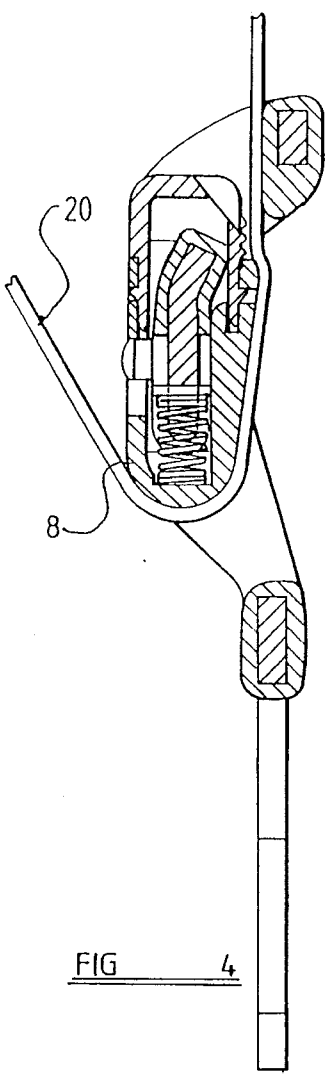
FIG. 4 is a corresponding view showing the tongue in a second condition.

FIG. 4 shows the tongue of FIG. 3, with the locking element in the locking position, and with a force applied to the clamping member 8 by the safety-belt 20 which is shown surrounding the lower part of the clamping member 8 and exerting an upward force. The locking member is in the locking position and the clamping member 8 cannot move to the clamping position.

Figure 5:
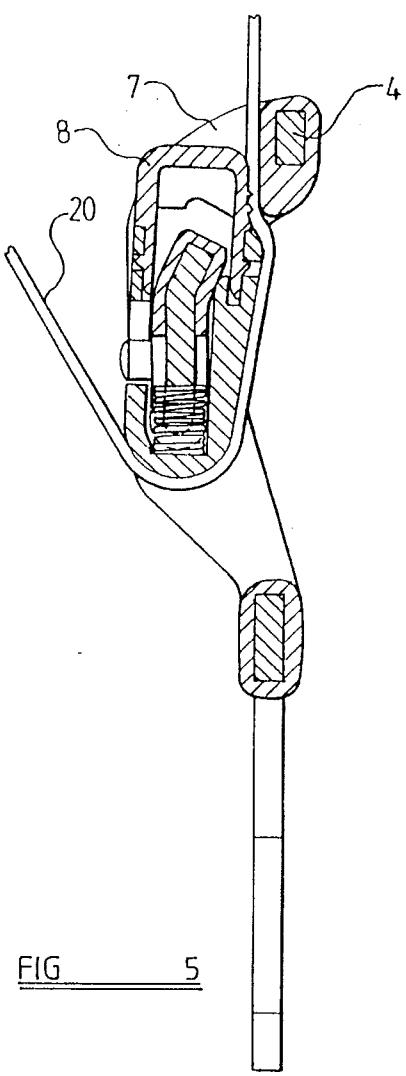
FIG. 5 is a further corresponding view showing the tongue in a further condition.

FIG. 5 illustrates a situation very similar to that shown in FIG. 4, but the locking element is in the release position. The clamping element has moved upward under the force applied to it by the belt 20, part of the belt being trapped between the portion of the frame 4 that defines the upper aperture 7 and the top part of the clamping member 8.

We claim:

1. A tongue for a safety-belt assembly having at least two apertures for receiving a safety belt, comprising:

a frame surrounding the at least two apertures;

a portion projecting from said frame and being receivable and retainable by a safety-belt buckle;

a clamping element mounted on said frame between the at least two apertures and being movable between a clamping position for clamping the safety belt between said frame and said clamping element, and a non-clamping position in which the safety-belt is freely movable between said frame and said clamping element; and a locking element attached to said frame in a region of said clamping element and movable between a locking position where said locking element is retained in a predetermined position relative to said frame and engages said clamping element so that said clamping element is retained and prevented from moving to the clamping position, and a release position where said clamping element is free to move to the clamping position.

2. A tongue according to claim 1 wherein the frame is a peripheral frame having a cross-arm, and defines the at least two apertures through which the safety-belt passes, the clamping element being mounted on the cross-arm and being movable to the clamping position in which part of the clamping element traps the safety-belt passing through one of said apertures against the peripheral frame.

3. A tongue according to claim 2 wherein the locking element comprises an element which is mounted on the cross-arm for movement transversely of the frame, the locking element carrying means which, when the locking element is in the locking position engage co-operating means formed on the clamping element to prevent the clamping element from moving to the clamping position.

4. A tongue according to claim 3 wherein the locking element carries means projecting through a slot formed in the clamping element, the slot being of substantially "L" configuration, the slot being such that when the locking element is in the release position, the projection is aligned with part of the "L"-shaped slot which is so orientated that the clamping element may move to the clamping position whereas when the locking element is in the locking position the projection is in part of the slot which is so orientated that the clamping element cannot move to the clamping position.

5. A tongue according to claim 4 wherein the locking element carries an extending projection, the projection being located so that when the locking element is in the locking condition the projection is immediately adjacent an abutment carried by the clamping element, thus preventing the clamping element from moving to the clamping position whereas when the locking element is in the release position, the projection is located adjacent a recess formed on the clamping element, so that the clamping element may move to the clamping position.

6. A tongue according to claim 7 wherein the locking element comprises an element movable in a slot formed in the cross-arm of the frame, the locking element being provided with at least one resilient finger carrying a projection, which projection is engagable with recesses forming part of the side wall of the slot to retain the locking element in the locking position or in the release position.

7. A tongue according to claim 4 wherein the locking element comprises an element movable in a slot formed in the cross-arm of the frame, the locking element being provided with at least one resilient finger carrying a projection, which projection is engagable with recesses forming part of the side wall of the slot to retain the locking element in the locking position or in the release position.

8. A tongue according to claim 3 wherein the locking element carries an extending projection, the projection being located so that when the locking element is in the locking position the projection is immediately adjacent an abutment carried by the clamping element, thus preventing the clamping element from moving to the clamping position whereas when the locking element is in the release position, the projection is located adjacent a recess formed on the clamping element, so that the clamping element may move to the clamping position.

9. A tongue according to claim 5 wherein the locking element comprises an element movable in a slot formed in the cross-arm of the frame, the locking element being provided with at least one resilient finger carrying a projection, which projection is engagable with recesses forming part of the side wall of the slot to retain the locking element in the locking position or in the release position.

10. A tongue according to claim 3 wherein the locking element comprises an element movable in a slot formed in the cross-arm of the frame, the locking element being provided with at least one resilient finger carrying a projection, which projection is engagable with recesses forming part of the side wall of the slot to retain the locking element in the locking position or in the release position.

* * * * *

UNITED STATES PATENT AND TRADEMARK OFFICE

CERTIFICATE OF CORRECTION

PATENT NO. : 5,471,717

DATED : December 5, 1995

INVENTOR(S) : Ennerdal, et al.

It is certified that error appears in the above-indentified patent and that said Letters Patent is hereby corrected as shown below:

On the Title page, before item [51], insert the following:
—[30] Foreign Application Priority Data
April 6, 1993 [GB] United Kingdom.....9307119—.

Signed and Sealed this

Twentieth Day of February, 1996

Bruce Lehman

BRUCE LEHMAN

*Commissioner of Patents and Trademarks*

*Attest:*

*Attesting Officer*